US011420218B1

(12) United States Patent
Foner

(10) Patent No.: US 11,420,218 B1
(45) Date of Patent: Aug. 23, 2022

(54) SPRAY NOZZLE FOR LOW CLEARANCE SPRAYING WITH FLOW SEAL

(71) Applicant: UDOR U.S.A. Inc., Lino Lakes, MN (US)

(72) Inventor: Clint Foner, Big Lake, MN (US)

(73) Assignee: UDOR U.S.A. INC., Lino Lakes, MN (US)

( * ) Notice: Subject to any disclaimer, the term of this patent is extended or adjusted under 35 U.S.C. 154(b) by 45 days.

(21) Appl. No.: 16/508,573

(22) Filed: Jul. 11, 2019

Related U.S. Application Data

(60) Provisional application No. 62/696,457, filed on Jul. 11, 2018.

(51) Int. Cl.
*B05B 1/04* (2006.01)
*B05B 1/26* (2006.01)

(52) U.S. Cl.
CPC ..... *B05B 1/267* (2013.01); *B05B 1/04* (2013.01)

(58) Field of Classification Search
CPC .. B05B 1/04; B05B 1/267; B05B 3/044; F16J 15/02
USPC ..... 277/626, 632, 641–644, 906, 921
See application file for complete search history.

(56) References Cited

U.S. PATENT DOCUMENTS 1,520,048 A * 12/1924 Baird ..... B05B 15/658 239/523
1,746,970 A * 2/1930 Steininger ..... B05B 1/267 239/511
2,644,718 A * 7/1953 Richard ..... B05B 15/658 239/521
2,721,764 A * 10/1955 Wilson, Jr. ..... B05B 1/3026 239/521
RE24,353 E * 9/1957 Kromer ..... B05B 1/267 239/505
2,896,865 A * 7/1959 Hamilton ..... B05B 1/267 239/521
3,257,079 A * 6/1966 Ross ..... B05B 1/323 239/113
3,502,098 A * 3/1970 Williams ..... B05B 1/267 239/521
4,167,247 A * 9/1979 Sons ..... B05B 1/267 239/455
5,657,928 A * 8/1997 Jian ..... B05B 1/3026 239/242
D458,342 S 6/2002 Johnson
D473,927 S 4/2003 Johnson
D474,255 S 5/2003 Johnson
D480,125 S 9/2003 Johnson
7,108,204 B2 9/2006 Johnson
7,487,924 B2 2/2009 Johnson
7,780,093 B2 8/2010 Johnson
8,328,112 B2 12/2012 Johnson
8,668,153 B2 3/2014 Johnson

* cited by examiner

*Primary Examiner* — Chee-Chong Lee
(74) *Attorney, Agent, or Firm* — Hamre, Schumann, Mueller & Larson, P.C.

(57) ABSTRACT

A two-part spray nozzle with body and head parts which are joined together is disclosed. The body and head include channels in planar surfaces which are ultimately joined with the channels in alignment. An elastomer, preferably having a cylindrical shape is inserted into the channel to provide a fluid tight seal between the head and body.

9 Claims, 14 Drawing Sheets

SPRAY NOZZLE FOR LOW CLEARANCE SPRAYING WITH FLOW SEAL

INCORPORATION BY REFERENCE

This application specifically incorporates the entire contents of the prior provisional application upon which it is based, namely U.S. provisional patent application Ser. No. 62/696,457 filed 11 Jul. 2018 entitled SPRAY NOZZLE FOR LOW CLEARANCE SPRAYING WITH FLOW SEAL.

FIELD OF THE INVENTION

The invention relates generally to spray nozzles, and more particularly to nozzles evenly dispersing fluid in a generally planar sector. An improved nozzle according to the present invention can more evenly distribute a fluid over the area covered by the nozzle's spray pattern than previous designs yet have a low ground clearance.

BACKGROUND OF THE INVENTION

Spray nozzles used for dispersing fluids are well known. In agricultural applications, nozzles that can evenly disperse a liquid agent (fertilizer, insecticide, water, etc.) are especially useful. The accuracy and consistency of nozzle spray patterns are important in modern systems due to advances in the agricultural sciences. For example, satellite surveys of fields can be used to direct GPS located vehicles for the accurate dispersion of agents on a crop, the dispersion pattern based on an analysis of the satellite survey. Given the precise distribution required by such a system, a nozzle that can accurately and consistently deliver an agent over a given area is highly desirable.

Flow through nozzles is typically quite turbulent. In the case of a liquid being discharged into the atmosphere, two-phase fluid interface conditions also exist. As a result, accurate modeling of nozzle performance by analytical means is highly complex, and may not be feasible. Therefore, optimization of nozzle performance generally requires testing various geometries by trial and error. In such testing, seemingly innocuous changes to geometry can make a significant difference in nozzle performance.

There is a need for a spray nozzle with superior dispersion characteristics. Especially desirable is a nozzle that can evenly distribute a fluid over the nozzle's spray area. The present invention fulfills these and other needs, and provides several advantages over prior spray nozzle systems.

Furthermore, in addition to being able to disburse fluid evenly along a wide swath, it is highly desirable to do this without using a boom or an arm which extended outwardly and had a plurality of nozzles spaced along the boom. Such "boomless" sprayers are advantageous because they allow the user, usually on a vehicle like a small truck or ATV, to spray far from the operator and not be bound by the interference of an extending boom.

U.S. Pat. Nos. D458342, 7,108,204, 7,487,924, 7,780,093, 8,328,112 and 8,668,153, illustrate a highly effective solution to this boomless spray challenge. In such this boomless spray configuration, the typical boom height was 2 or 5 feet (0.5-2 meters) from the nozzle to the ground. In certain configurations it is critical to get as low as 12 inches (30 cm) to the ground yet the sideway "throw" of the nozzle. Such low clearance boomless spaying has heretofore been impossible without losing lateral range (3-5 meters) or maintaining an even flow across the entire length of the throw.

It has become apparent the efficiency of this nozzle could be increased by eliminating spurious flows which can occur between flat, especially metal to metal interfaces. The present invention addresses these problems.

SUMMARY OF THE INVENTION

To overcome the limitations in the prior art described above, and to overcome other limitations that will become apparent upon reading and understanding the present specification, the present invention discloses a spray nozzle design.

In one embodiment there is disclosed a spray nozzle, having any or all of the following elements:

- a nozzle body having a first body planar contact surface in a first plane and a second body planar contact surface offset from said first contact surface in a second body plane but offset a predetermine distance from said first body planar surface and said second body contact surface having a peripheral edge;
- a nozzle head having a first head contact surface and a second head planar contact surface offset from said first head planar contact surface; said second head planar contact surface having a peripheral edge;
- a first channel formed in second body planar surface extending from one point on said peripheral edge to another point on said peripheral edge;
- a second channel formed in said second nozzle planar surface extending from one point on said peripheral edge to another point on said peripheral edge;
- said first and second channels being located on their respective planar contact surfaces so that the channels are aligned and overlapping when said head and body are emplaced;
- an elastomer sized to be receivable within said channels such that when emplaced within one of the channels, it extends into the other of said channels thereby creating an elastomeric seal between said nozzle body and head along said channel.

Also disclosed is a spray nozzle wherein said channels each have spaced apart vertical sidewalls and a planar bottom wall therebetween.

Also disclosed is a spray nozzle wherein said channels each have spaced apart vertical sidewalls and a concave bottom wall therebetween, and wherein said elastomer has a tubular cross section.

Also disclosed is a spray nozzle wherein said channels each have spaced apart vertical sidewalls and a v-shaped bottom wall therebetween.

Also disclosed is a spray nozzle wherein said elastomer has a cross sectional area greater than or equal to the cross sectional area of the first and second channels.

Also disclosed is a spray nozzle wherein said elastomer has a cross sectional area greater than the cross sectional area of the first and second channels and wherein the elastomer is compressible to fit within the channel and exert a bias force against said channel.

Also disclosed is a spray nozzle wherein the body further includes a mounting hole for affixing the head to the body and wherein said first channel intersects said mounting hole.

Also disclosed is a spray nozzle wherein the body further includes a mounting hole for affixing the head to the body and wherein said first channel is spaced from said mounting hole.

Also disclosed is a spray nozzle wherein the elastomer is an injectable fluid which hardens in place.

Also disclosed is a spray nozzle, having any or all of the following elements:

a nozzle body having a first body planar contact surface in a first plane and a second body planar contact surface offset from said first contact surface in a second body plane but offset a predetermine distance from said first body planar surface and said second body contact surface having a peripheral edge;

a nozzle head having a first head contact surface and a second head planar contact surface offset from said first head planar contact surface; said second head planar contact surface having a peripheral edge;

a first channel formed in second body planar surface extending from one point on said peripheral edge to another point on said peripheral edge;

a second channel formed in said second nozzle planar surface extending from one point on said peripheral edge to another point on said peripheral edge;

said first and second channels being located on their respective planar contact surfaces so that the channels are aligned and overlapping when said head and body are emplaced;

an elastomer sized to be receivable within said channels such that when emplaced within one of the channels, it extends into the other of said channels thereby creating an elastomeric seal between said nozzle body and head along said channel.

Also disclosed is a method preventing leakage in a spray nozzle having a nozzle body having a first body planar contact surface in a first plane and a second body planar contact surface offset from said first contact surface in a second body plane but offset a predetermine distance from said first body planar surface and said second body contact surface having a peripheral edge;

a nozzle head having a first head contact surface and a second head planar contact surface offset from said first head planar contact surface; said second head planar contact surface having a peripheral edge; comprising any or all of the following steps in any order of:

forming a first channel in second body planar surface;

extending the first channel from one point on said peripheral edge to another point on said peripheral edge;

forming a second channel in said second nozzle planar surface;

extending the second channel from one point on said peripheral edge to another point on said peripheral edge;

locating said first and second channels on their respective planar contact surfaces so that the channels are aligned and overlapping when said head and body are emplaced;

inserting an elastomer sized within said channels such that when emplaced within one of the channels, it extends into the other of said channels thereby creating an elastomeric seal between said nozzle body and head along said channel.

Also disclosed is a method wherein the elastomer is injected into the channel after the head and body are brought together.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
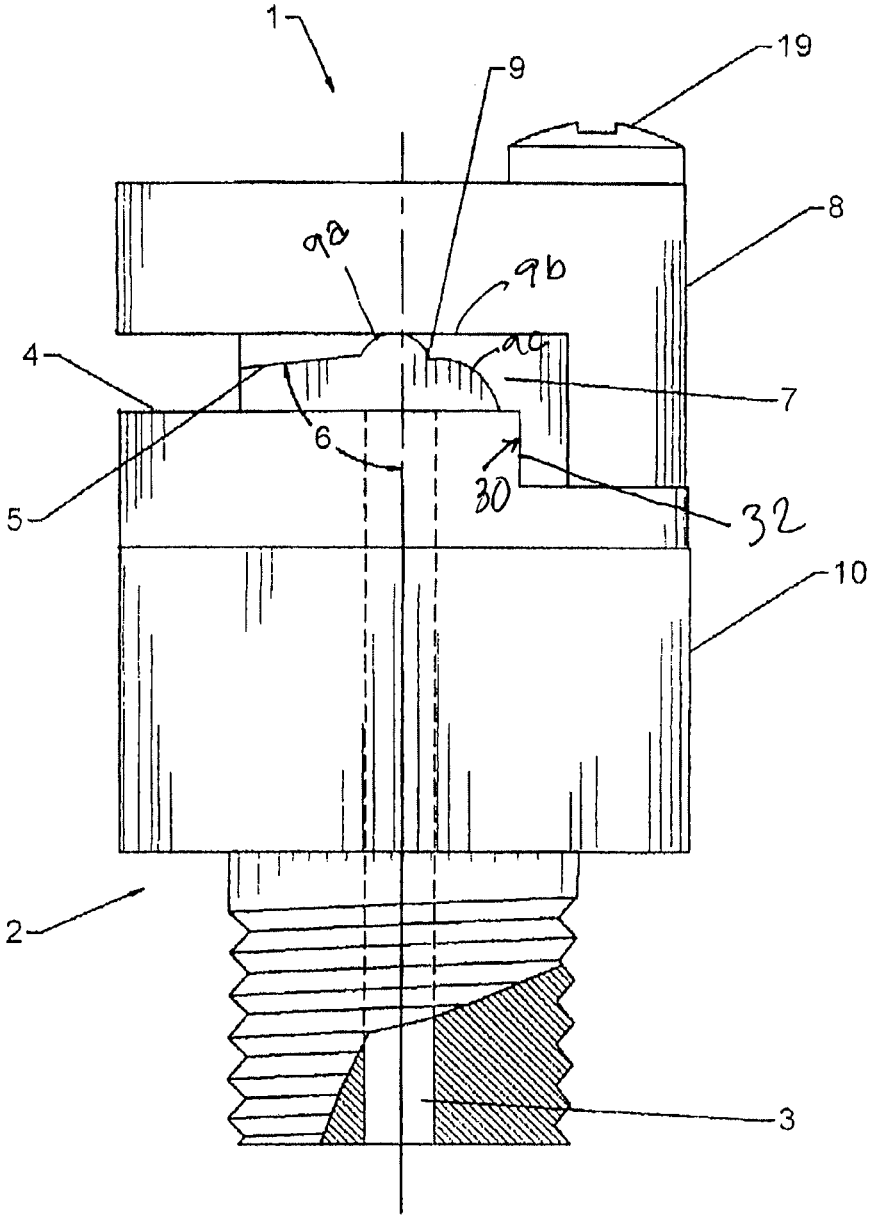
FIG. 1 is a side view of a nozzle according to the present invention.

While the invention is amenable to various modifications and alternative forms, specifics thereof have been shown by way of example in the drawings and will be described in detail herein. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized and structural and functional changes may be made without departing from the scope of the present invention.

The following patents are incorporated by reference: U.S. Pat. Nos. D458342, 7,108,204, 7,487,924, 7,780,093, 8,328,112 and 8,668,153.

Turning to FIG. 1, a side view of a nozzle, generally designated by reference numeral 1, is illustrated. The nozzle 1 includes a fluid fitting 2 which allows the nozzle 1 to be mounted to a fixture (e.g. a pipe or spray boom). The fluid fitting 2 also provides a fluid connection for the orifice 3. The orifice 3 allows fluid to pass from the fluid fitting 2 to where it exits at the discharge surface 4.

The discharge surface 4 is oriented substantially perpendicular to the orifice 3. The discharge surface 4 as shown in FIG. 1 is substantially planar. Opposite the discharge surface 4 is the impingement surface 5. The impingement surface 5 is oriented at an angle 6 relative to the centerline of the orifice 3. The impingement surface 5 may be oriented such that it has an impingement angle 6 less than 90 degrees which provides a restriction for fluid flowing between the discharge surface 4 and impingement surface 5. It is understood that a range of angles can be defined between an arbitrarily oriented line and surface (e.g. plane), and the impingement angle 6 is the smallest angle that can be formed between the orifice centerline and the impingement surface 5.

Fluid exiting the orifice 3 will impact the impingement surface 5. The impinging fluid forms an impingement flow upon striking the impingement surface 5. Impingement flow is an external flow (e.g. stream or jet) that is redirected due to impacting a surface at an impingement point. The impingement flow appears as a thin sheet of fluid that spreads out in all directions across the impinged surface from the impingement point. Part of the impingement flow in the nozzle 1 is forced directly out the gap between the impingement surface 5 and the discharge surface 4. Fluid is blocked in other directions by the deflection ridge 7. The deflection ridge 7 bridges the gap between the impingement surface 5 and the discharge surface 4, thereby limiting the flow to a partial circumferential angle (i.e. less than 360 degrees) around the nozzle 1. As shown in FIG. 1, the deflection ridge 7 can be formed at least in part by a fillet/ball cut/trough between the impingement surface 5 and the body of the spray head 8. It is preferably curved or hemispherical. The deflection ridge 7 in this embodiment interfaces with the impingement surface 5 at ridge interface 9 which may or may not have a sharp corner. From ridge interface 9 is a trough/cut/depression 9*a* which is cut into the impingement surface 5 preferably to the base/floor 9*b* of the head 8. The floor 9*b* is defined as the base surface from which the impingement surface 5 extends outwardly therefrom.

This trough or cut 9*a* is preferably a ball cut or hemispherical with the base thereof extending to the base 9*b*. Cut 9*a* extend substantially along the entire impingement surface as shown in various embodiments in FIGS. 3-7. Notice that in the preferred embodiment cut 9*c* is roughly only a quarter turn (roughly 90 degrees whereas cut 9*a*, is nearly 180 degrees or a half turn.

I have found that this trough provides dramatically enhanced performance of the nozzle when placed in low clearance above the ground, typically 12 inches to 3 feet (30 cm-1 meter). The invention is not limited to placement at these ground clearances, but has the unexpected result of still being able to provide a long even distribution throw out many feet/meters (for example 10 feet/3.5 m).

There are other configurations available besides this preferred configuration. For example, the ball cut/trough/depression 9*a*, may be "V" shaped or curved but not hemispherical, such as oval or as a hyperbola, radiused or other curvature. Ridge interface 9 may be sharp transition as shown or rolled off/gradual.

Furthermore, the base of the cut 9*a* does not have to be limited to the floor 9*b*. It may be cut into the floor or may be elevated thereabove. The optimal cut for a particular need can be determined without undue experimentation.

So in this embodiment, there is a first cut 15, preferably hemispherical, a ridge interface 9, preferable sharp, and then a further cut 9*a* into the head, this cut having a cross section smaller than the cross section of cut 15.

The fluid plume exiting the nozzle is formed of two flow components. The first flow component is impingement flow that directly exits the nozzle 1. The second flow component includes impingement flow that hits the deflection ridge 7 and is thereby deflected out the nozzle 1. Since these two flow components have different paths, they will achieve different states (e.g. velocities) when exiting the nozzle 1. By careful design of geometric features (e.g. size and shape of the impingement surface 5 and deflection ridge 7), these two flow components can be tuned such that the resultant flow has even dispersion characteristics over an area covered by the nozzle plume.

Figure 2:
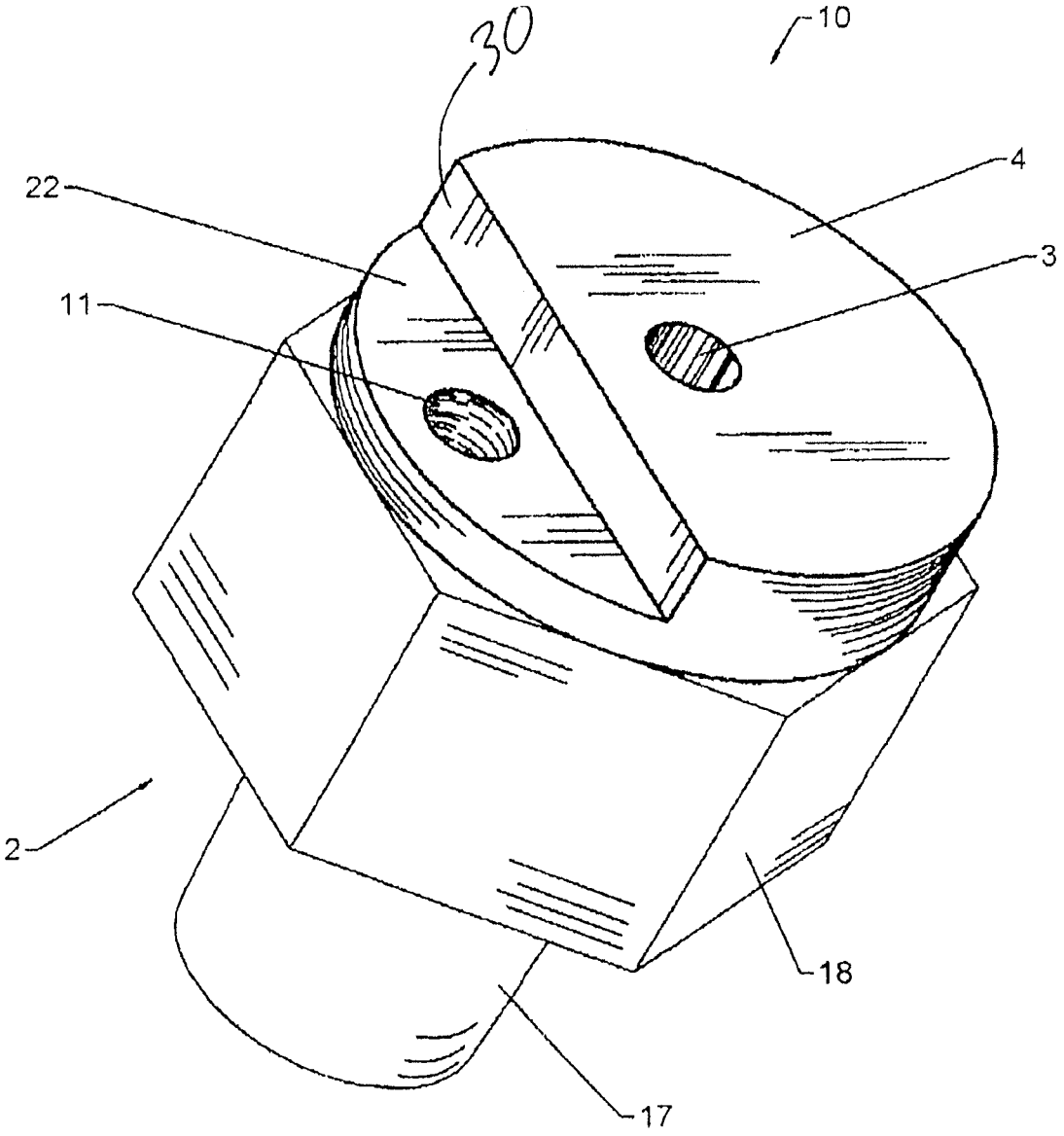
FIG. 2 is a perspective view of a nozzle body according to the present invention.

In one embodiment, the nozzle 1 is made of two pieces, a spray head 8 and a nozzle body 10. FIG. 2 illustrates one configuration of a nozzle body 10. The nozzle body 10 includes an orifice 3 and a discharge surface 4. The nozzle body 10 also includes a fluid fitting 2. The fluid fitting 2 may include a threaded shaft 17 and a hexagonal perimeter 18 suitable for tightening with a standard wrench. Other configurations of a fluid fitting 2 can be used that are well known in the art. For example, members that can serve as a fluid fitting 2 include a flange, a pneumatic-style quick disconnect, or a weldment. The body can be made of metals or plastics. The body may include a step 30 which mates with its counterpart step 32 in the head. This step provides a reliable interface between the parts and prevents rotation or misalignment, but other means to do this are possible, such as alignment pins.

Figure 3:
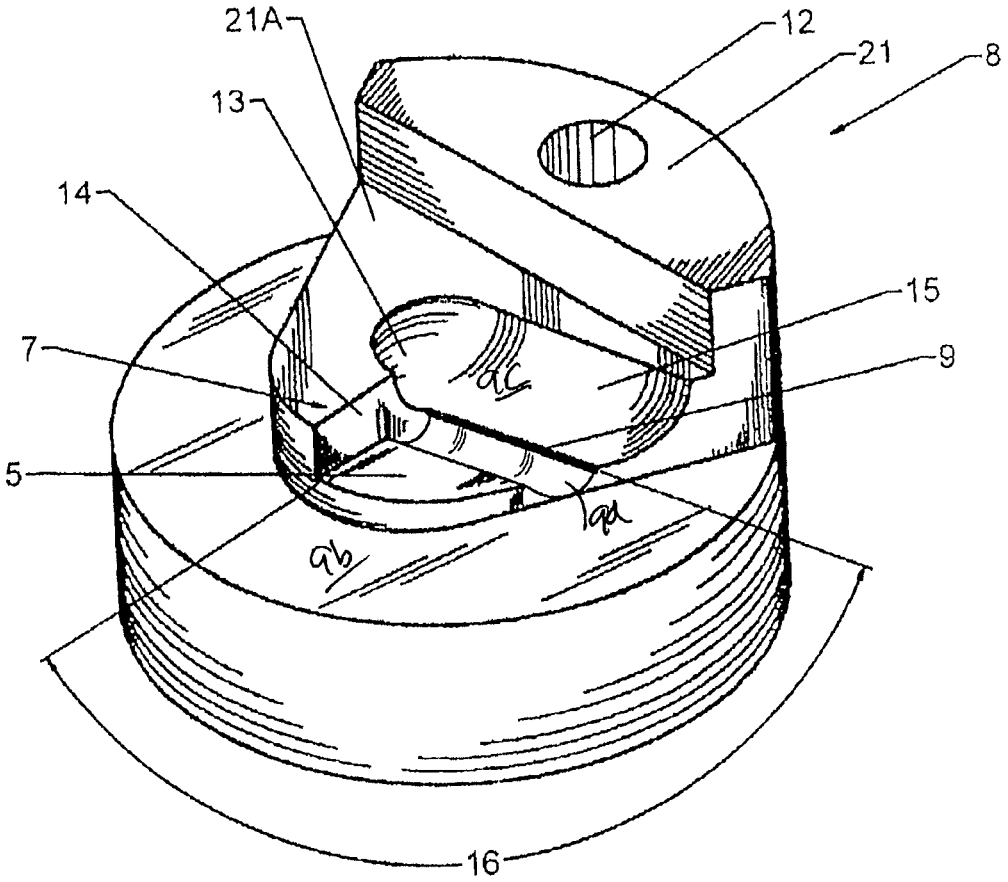
FIG. 3 is a perspective view of an embodiment of a spray head according to the present invention.

The body 10 also includes a mounting hole 11 and mounting surface 22 that can be used to interface with a spray head 8. One embodiment of a spray head 8 is shown in FIG. 3. The spray head 8 includes a mounting hole 12 and mounting surface 21 that lines up with the mounting hole 11 and mounting surface 22 on the body 10. The mounting holes 11, 12 are aligned so that the spray head 8 and body 10 can be assembled using a fastener such as a screw 19 (best seen in FIG. 1).

Referring again to FIG. 3, the spray head 8 includes a sealing surface 21A that interfaces with the body's discharge surface 4 when the spray head 8 and body 10 are mated together. The sealing surface 21A is generally triangular in shape, which includes the inverted triangle shown in FIG. 8, with a base of the triangle located adjacent the mounting surface and the tip 9*f* (which also includes the inverse tip 9*f* in FIG. 8) opposite the base oriented towards the nozzle's direction of discharge. The tip of the triangular shaped sealing surface 21A has a rounded profile. The impingement surface 5 is formed as a planar indentation/step in the sealing surface 21A. The interface between the impingement surface 5 and the sealing surface 21A defines the deflection ridge 7. At least part of the deflection ridge 7 is adjacent to the triangular base of the sealing surface 21A, thereby deflecting fluid generally towards the rounded triangular tip of the sealing surface 21A.

In the embodiment illustrated in FIG. 3, the deflection ridge 7 is formed by the intersection of two features, a sharp corner 14 and a filleted corner 15. The sharp corner 14 and the filleted corner 15 intersect at a spray angle 16. The spray angle 16 influences the shape of the discharged fluid plume. The filleted corner 15 extends past the intersection of the filleted corner 15 with the sharp corner 14, such that a spherical indentation 13 is formed at the intersection. The spherical indentation 13 is located approximately near the impingement point of the flow leaving the orifice 3. As shown in FIG. 3, a further cut/trough/depression 9*a* does not have the same spherical indentation 13, but is an option which could be added so that both 9*a* and 9*c* terminate in a spherical end similar to 13. The filleted corner 15 joins with the impingement surface 5 at a sharp ridge interface 9. The sharp ridge interface 9 can be formed as a substantially 90 degree corner line along the length of the filleted corner 15. Alternatively, the sharp ridge interface 9 may be formed by a wedge shaped ridge such that there is a smooth interface where the filleted corner 15 joins the impingement surface 5 near the spherical indentation 13, thereafter forming an increasingly deeper corner line as the sharp ridges extends towards the trailing edge of the filleted corner 15. The spray head 8 embodiment illustrated in FIG. 3 has been found especially useful for spray angles 16 ranging from about 80 degrees to about 120 degrees. It is appreciated that a mirror image arrangement of features shown in FIG. 3 would allow a similar spray pattern to be formed in a direction opposite of that shown in FIG. 3. The further cut/trough 9*a* extends from ridge interface 9 into the body of the head, and then rises up to the remainder of the impingement surface 5.

Figure 4:
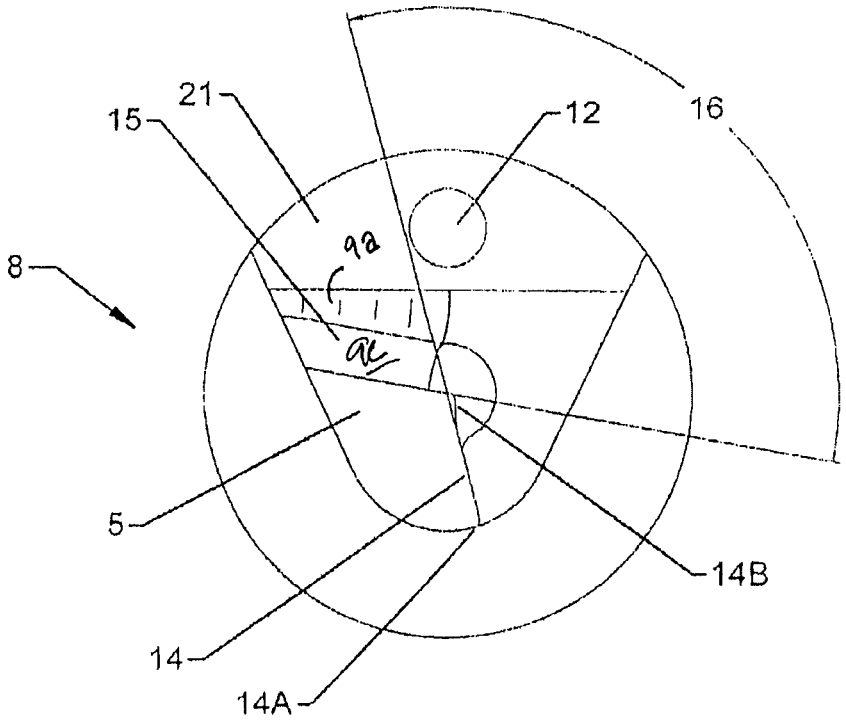
FIG. 4 is a plan view of an alternate embodiment of a spray head according to the present invention.

Turning now to FIG. 4, a spray head 8 similar to the embodiment shown in FIG. 3 is illustrated with additional features for improving spray dispersion characteristics. The spray head 8 includes a trailing edge curve 14A and a leading edge curve 14B located on the sharp corner 14. The trailing edge curve 14A is located at a distal (outward) end of the sharp corner 14, and extends inwards towards the filleted corner 15. The leading edge curve 14B is located near the intersection of the sharp corner 14 and the filleted corner 15, and extends away from the filleted corner 15. The vertical surface of the sharp corner 14 remains substantially perpendicular to the sealing surface 21A at the trailing and leading edge curves 14A, 14B. It has been found that inclusion of trailing and leading edge curves 14A, 14B provides more even dispersion of fluid in nozzles with a spray angle of less than 140 degrees.

Figure 6:
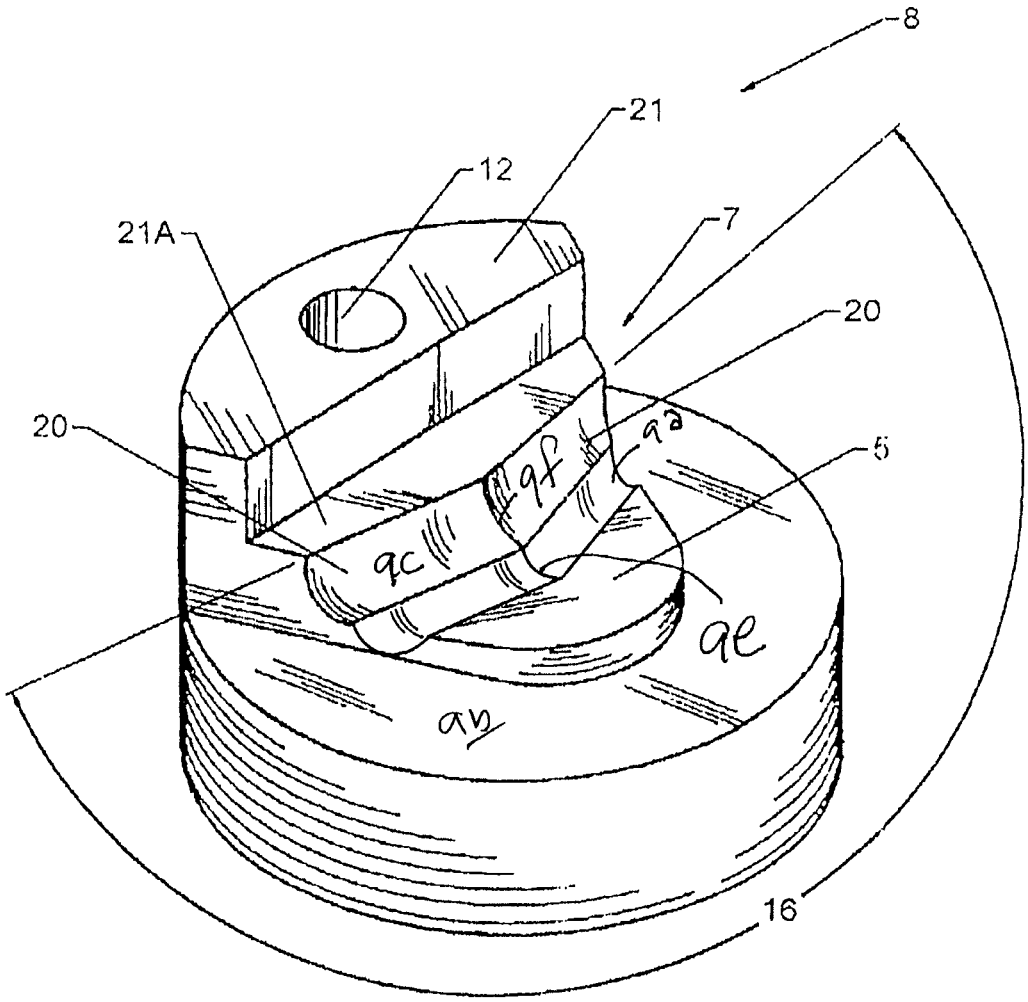
FIG. 6 is a perspective view of another embodiment of a spray head according to the present invention.
Figure 8:
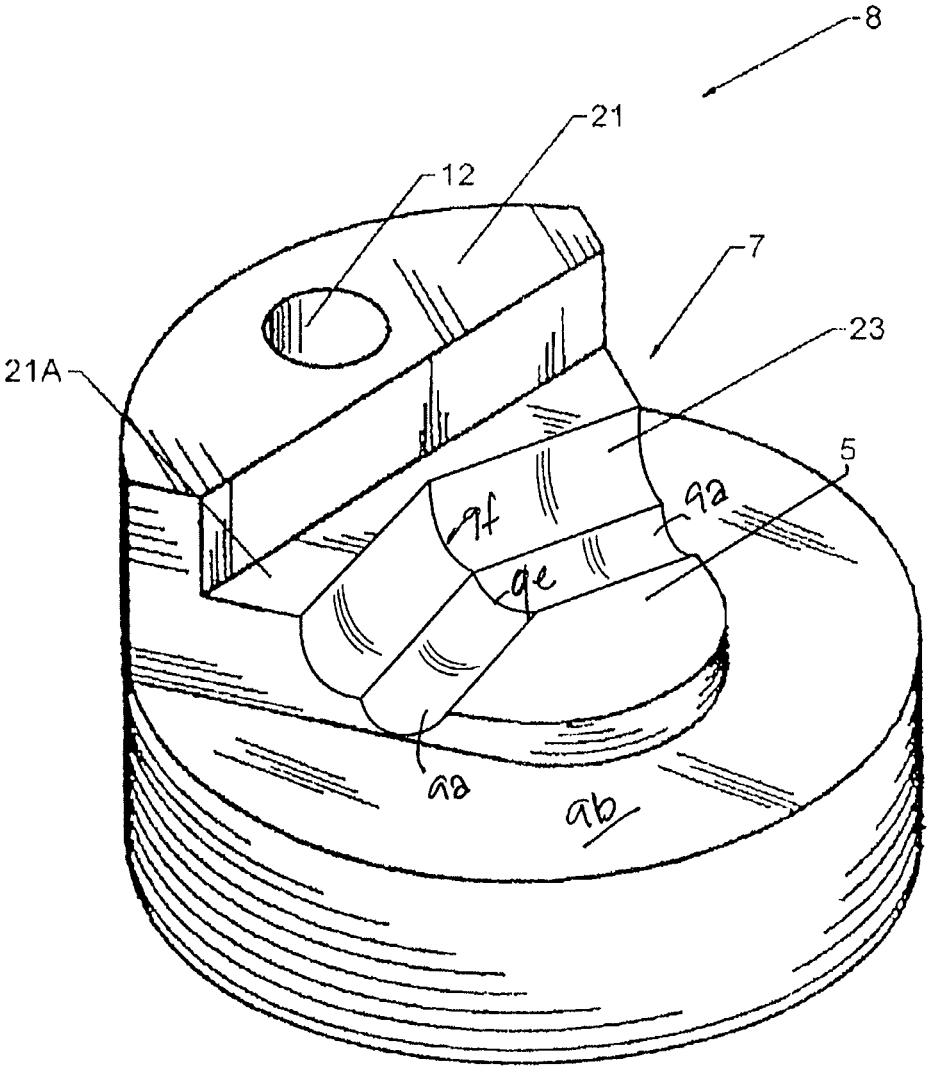
FIG. 8 is a view like FIG. 6 except that the deflection ridge is an inverted V shape when compared to FIG. 6.

Another embodiment of a spray head 8 is shown in FIGS. 6 and 8 which differ in that FIG. 6 has a V shape with the center apex protruding outwardly (called convex for simplicity) whereas FIG. 8 has a central apex extending inwardly, or inwardly pointing, (called concave for simplicity). In this embodiment, the deflection ridge 7 is formed by two filleted corners 20. The filleted corners 20 intersect at a spray angle 16 along line 9*f*.

The filleted corners 20 smoothly join with the impingement surface 5. This configuration is especially useful in spray angles 16 ranging from about 180 degrees to about 220 degrees. Link in the previous embodiments, portion 9*c* is adjacent recess 9*a* and join at line 9*e*.

Figure 7:
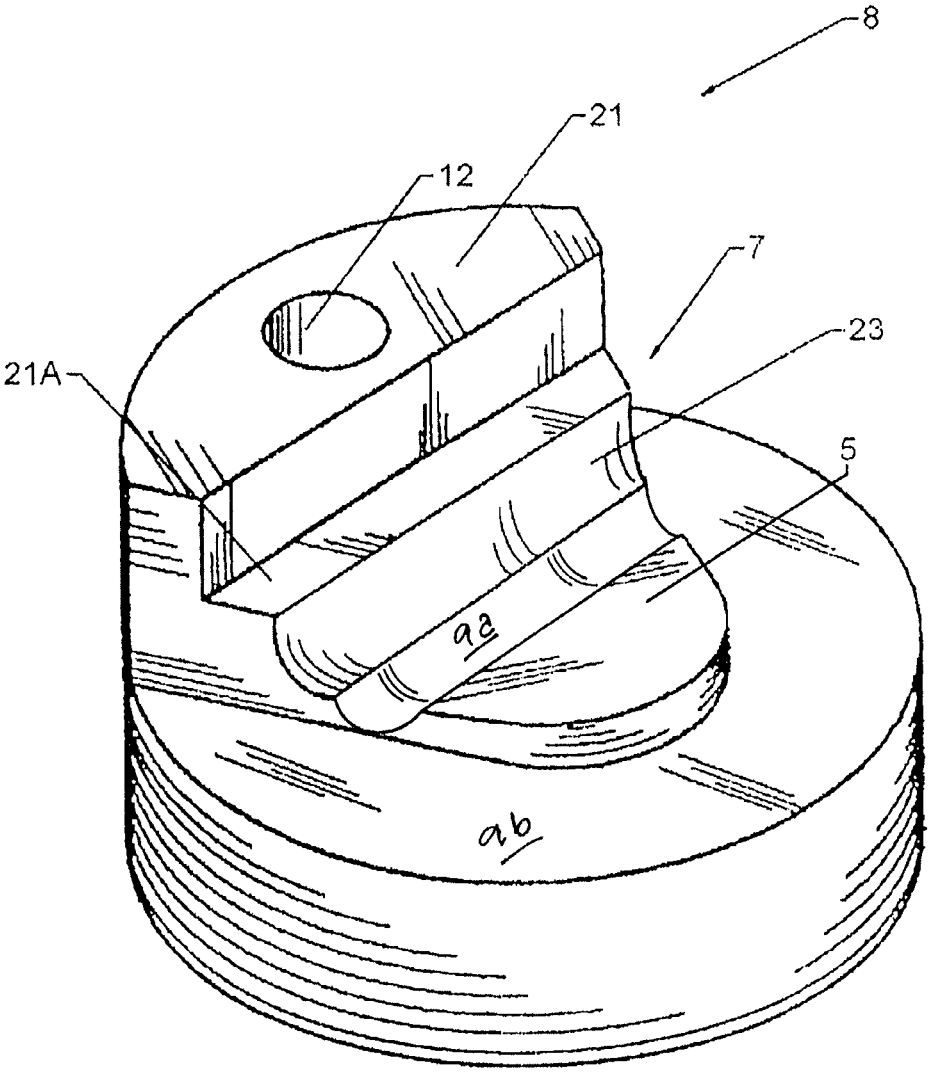
FIG. 7 is a perspective view of yet another embodiment of a spray head according to the present invention.

Yet another embodiment of a spray head 8 is shown in FIG. 7. In this embodiment, the deflection ridge 7 is formed by one filleted corner 23. The filleted corner 23 smoothly joins with the impingement surface 5. This configuration provides an approximately 180 degree spray pattern.

The spray head 8 illustrated in FIGS. 3-7 include mounting holes 12 and interface surfaces 21 that are identically configured. This allows spray head 8 of various geometries to be interchangeable on the body 10. Interchangeability of the spray head 8 allows for easy reconfiguration of a spray patterns on a system using a nozzle 1 according to the present invention. An interchangeable spray head 8 also allows for easy replacement of worn or damaged spray heads 8.

A nozzle 1 according to the present invention can be fabricated from a number of suitable materials. For a discharge of liquids in an agricultural application, the nozzle 1 can be formed from corrosion resistant steel such as 303 stainless steel. Other materials such as brass, carbon steel, aluminum, polymers and ceramics may be appropriate for the spray head 8 and/or the body 10 depending on the fluid to be discharged and the desired wear characteristics of the nozzle 1.

Figure 9:
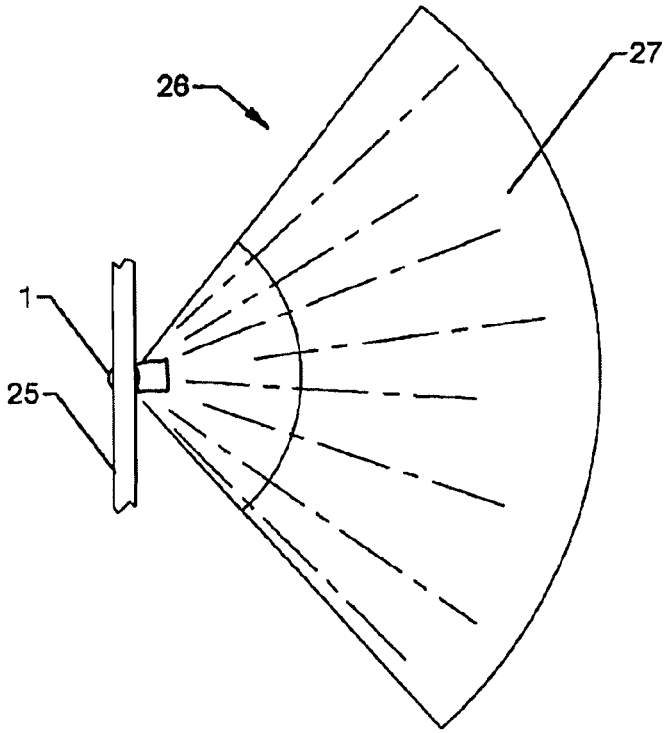
FIG. 9 is a top view showing a nozzle plume from a nozzle according to the present invention.
Figure 10:
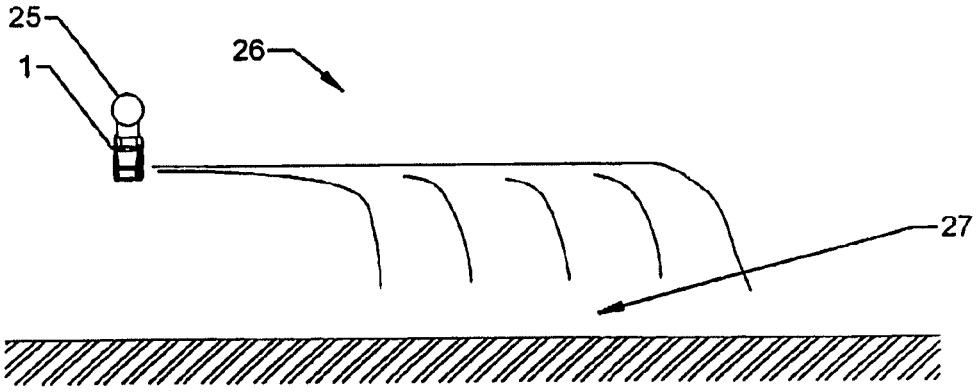
FIG. 10 is a side view of the nozzle plume from FIG. 9.

Referring now to FIG. 8, a top view is shown of spray system with a nozzle 1 mounted upside down and vertically to a manifold 25. A plume 26 exits from the nozzle 1. The coverage area 27 is a sector shape with an angle determined by the nozzle's spray angle 16. In FIG. 9 a side view of the plume 26 shows the shape of the plume as it leaves the nozzle 1 and travels to the ground. A nozzle according to the present invention can provide a very even dispersion of fluid over the coverage area 27. This characteristic of even dispersion over a given area is highly advantageous when precise amounts of fluid are to be distributed.

A configuration of a nozzle 1 according to the present invention is described hereinbelow that is particularly suited for discharging aqueous liquids into the atmosphere at a relative fluid pressure in a range of about 25 psi to about 35 psi. Such a configuration uses an orifice diameter of about 0.125 inches and a deflection angle 6 of about 85 degrees (±2 degrees). In such an application, a spray head 8 configured according to FIG. 3 includes a filleted corner 15 created using a 0.187 inch diameter ball end-mill cutting about 0.087 inches deep as measured from the sealing surface 21A. The spray head 8 in this example further includes a sharp ridge interface 9 with height of about 0.013 inches, the sharp ridge interface 9 being located at the interface between the filleted corner 15 and the impingement surface 5. The spray angle 16 is about 100 degrees. With the nozzle elevated about 36 inches from the ground, such an arrangement provides a spray pattern with even coverage to about 17 feet from the nozzle.

Figure 5:
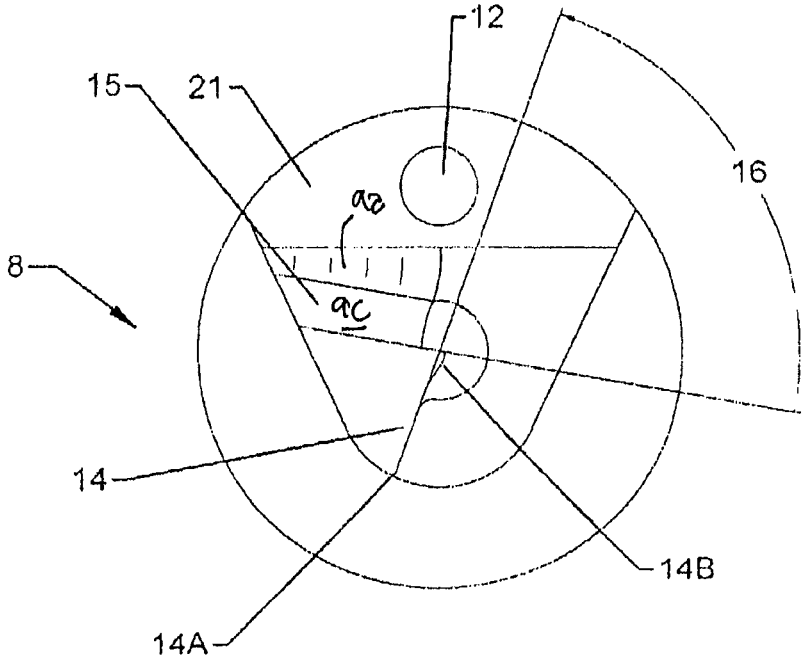
FIG. 5 is a plan view of an another embodiment of a spray head according to the present invention.

The spray head 8 illustrated in FIG. 4 has a geometry similar to that of FIG. 3, except that the spray angle 16 is about 115 degrees. This embodiment also includes a trailing edge curve 14A with diameter of about 0.063 inches. A leading edge curve 14B about 0.060 inches long and extends away from the apparent intersection of the sharp corner 14 and the filleted corner 15 by a maximum distance of about 0.011 inches. The spray head 8 shown in FIG. 5 is similarly configured, except the spray angle 16 is about 80 degrees.

In another similar application (i.e. 25-35 psi fluid pressure, 0.125 orifice diameter, and 85 degree deflection angle), a spray head configured according to FIG. 6 can provide an even distribution of fluid out to 22 feet from a nozzle elevated at about 40 inches from the ground. In this configuration, the filleted corners 20 are formed with a 0.187 diameter ball end-mill, the fillets smoothly interfacing with the impingement surface 5. The spray angle 16 in this configuration is about 200 degrees. Notice that FIGS. 6 and 7 have two-part section 9*a* and 9*c* which come to a point of intersection 9*e* and 9*f*. These are shown as sharp intersecting lines but may also be a curvature.

An alternate embodiment is shown in FIGS. 11-16. To the extent this new embodiment is similar to prior embodiments herein, the same numerals are used and the prior explanatory material should be referred to.

Generally speaking, a nozzle body having a first body planar contact surface 4 in a first plane and a second body planar contact surface 22 offset from said first contact surface in a second body plane but offset a predetermine distance from said first body planar surface and said second body contact surface having a peripheral edge, i.e. the circumference of the body. The offset is the stepwise differential between the planes. The advantage of this step is to keep the head from rotating.

There is a nozzle head 8 having a first head contact surface 21 and a second head planar contact surface 21A offset from said first head planar contact surface; said second head planar contact surface having a peripheral edge, i.e. the circumference of the head.

A first channel 130 is formed in second body planar surface 22 extending from one point on said peripheral edge to another point on said peripheral edge, i.e. from end to end of the circumference. The channel may be formed by milling, ablating, etching, part of a die/mold or other known means. The depth of the channel should be sufficient to receive at least a portion of a seal or sealant, preferably about 50% of tubular seal.

A second channel 132 is formed in said second nozzle planar surface extending from one point on said peripheral edge to another point on said peripheral edge. The channel may be formed by milling, ablating, etching, part of a die/mold or other known means. The depth of the channel should be sufficient to receive at least a portion of a seal or sealant, preferably about 50% of tubular seal.

The first and second channels are located on their respective planar contact surfaces so that the channels are aligned and overlapping when said head and body are emplaced together with the channels fully aligned. That means that together channels 130 and 132 form a fully enclosed "tunnel" through the head, near an impingement surface. Then an elastomer 134 sized to be receivable within said channels is emplaced within one of the channels or both. The elastomer extends into the other of said channels thereby creating an elastomeric seal between said nozzle body and head along said channel. In the case of an elastomer, the preferred circumference is just larger or equal to a cross sectional dimension of the tunnel so that the elastomer is compressed therein forming a tight seal. In the case of a flowing sealant, it is preferred that the sealant either be injected into the tunnel after the two parts are assembled or be applied to both channels, excess scraped away before assembly and then the sealant have some expansion when curing.

The channels may each have spaced apart vertical sidewalls and a planar bottom wall therebetween.

The channels may each have spaced apart vertical sidewalls and a concave/curved bottom wall therebetween, and the elastomer may have a tubular cross section, v-shaped cross section or other shape fitted to the trough/channel.

The channels each may have spaced apart vertical sidewalls and a v-shaped bottom wall therebetween.

The elastomer may have a cross sectional area greater than or equal to the cross sectional area of the first and second channels.

The elastomer may have a cross sectional area greater than the cross sectional area of the first and second channels and the elastomer may be compressible to fit within the channel and exert a bias force against said channel.

Figure 11:
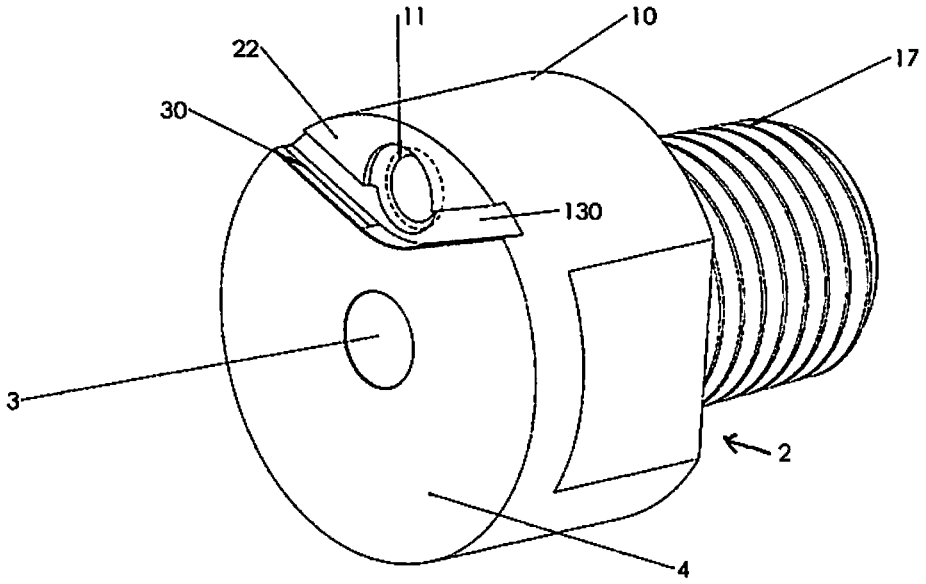
FIG. 11 is an end perspective view like FIG. 2 of an alternate embodiment of the base with a sealant recess.

The nozzle body 2 may include mounting hole 11 for affixing the head to the body and wherein said first channel 130 intersects the mounting hole and becomes part of the elastomer which prevents fluid from entering the mounting hole. The channel may also follow the same path as shown in FIG. 11 but be spaced from the hole so there is no intersection.

The elastomer may be an injectable fluid which hardens in place. It can be injected before or after the two parts are joined but easier if they are screwed tightly together. The elastomer or adhesive may be an expandable type or foam which expands to fill the two channels simultaneously.

A method preventing leakage in a spray nozzle is disclosed where the nozzle body having a first body planar contact surface in a first plane and a second body planar contact surface offset from said first contact surface in a second body plane but offset a predetermine distance from said first body planar surface and said second body contact surface having a peripheral edge. The nozzle head also may have a first head contact surface and a second head planar contact surface offset from said first head planar contact surface; said second head planar contact surface having a peripheral edge.

The method includes any or all of the following steps in any order of:

- forming a first channel in second body planar surface;
- extending the first channel from one point on said peripheral edge to another point on said peripheral edge;
- forming a second channel in said second nozzle planar surface;
- extending the second channel from one point on said peripheral edge to another point on said peripheral edge;
- locating said first and second channels on their respective planar contact surfaces so that the channels are aligned and overlapping when said head and body are emplaced;
- inserting an elastomer sized within said channels such that when emplaced within one of the channels, it extends into the other of said channels thereby creating an elastomeric seal between said nozzle body and head along said channel.

Also disclosed is a method wherein the elastomer is injected into the channel after the head and body are brought together.

FIG. 11, similar to FIG. 2, illustrates one configuration of a nozzle body 10. The nozzle body 10 includes an orifice 3 and a discharge surface 4. The nozzle body 10 also includes a fluid fitting 2. The fluid fitting 2 may include a threaded shaft 17 and a cylindrical or hexagonal perimeter (not shown in this embodiment) 18 suitable for tightening with a standard wrench. Other configurations of a fluid fitting 2 can be used that are well known in the art. For example, members that can serve as a fluid fitting 2 include a flange, a pneumatic-style quick disconnect, or a weldment. The body can be made of metals or plastics. The body may include a step 30 which mates with its counterpart step 32 in the head. This step provides a reliable interface between the parts and prevents rotation or misalignment, but other means to do this are possible, such as alignment pins.

Since the nozzle body 10 and spay head 8 are joined along surfaces which include a fluid port, even a small misalignment can result in leakage between the two bodies. Of course leakage is undesirable because of loss of fluid, such as herbicide, fertilizer, etc., but it can also create droplets which may interfere with the spray pattern by disruption.

To solve this potential problem, a notch/slot has been cut/formed in both the head and base, or either one. An elastomeric seal is inserted into the notch/slot to create a sealing surface. The seal may be a cylindrical gasket, having the cross section of a partial O-ring, such as a tubular elastomer, for example, or other cross sectional shape, which when compressed between the two parts, will fill most of the slot space and form a tight seal with the head and base surfaces. The elastomer can also be in the form of an adhesive or expandable adhesive which will fill the space when cured. Other fillers are possible.

Turning to the figures, FIG. 11 shows a nozzle body 20 further including a channel/recess/slot/trough 130 which abuts all 30 and aperture 10 in this embodiment. This channel 130 has vertical sidewalls orthogonal to the base of the channel, though the channel may be convex, concave, circular, v-shaped or other profile which will provide sealing walls for an elastomer.

It is possible that the channel may be set back closer to hole 3 so that the channel 130 does not intersect aperture 11 which will make the seal easier to achieve but then other accommodates must be made in the head 8.

FIG. 11 illustrates a head 8 which differs from similar heads described herein by the addition of channel/recess/slot/trough 132 which like channel 130 has vertical sidewalls orthogonal to the base of the channel, though the channel may be convex, concave, circular, v-shaped or other profile which will provide sealing walls for an elastomer. Channels 130 and 132 are located so that they substantially align when the head is affixed to the body. It is also possible that only one of channels 130 or 132 are provided and the part without the channel will have a planar surface which engages the elastomer.

The presence of one or more channels 130/132 provides a liquid barrier to fluids which impinge on portions of the head or body or which could leak out of passage 12. Any stray flow of fluid can cause interference with the intended spray pattern because large droplets of leaking fluid have greater inertia than smaller once and smaller ones will be deflected by or attach to the larger ones.

Figure 12:
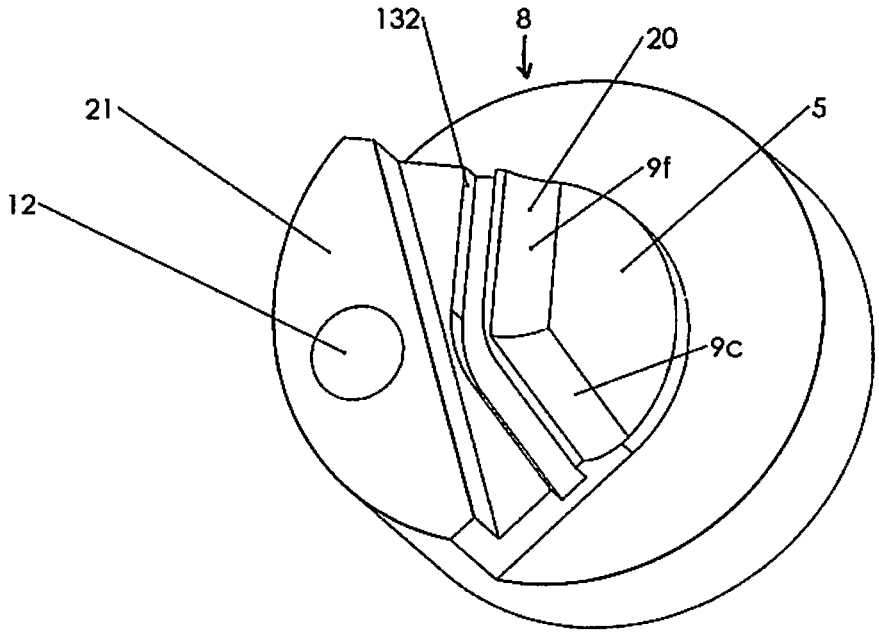
FIG. 12 is a top perspective view similar to FIG. 6 with a sealant recess.
Figure 13:
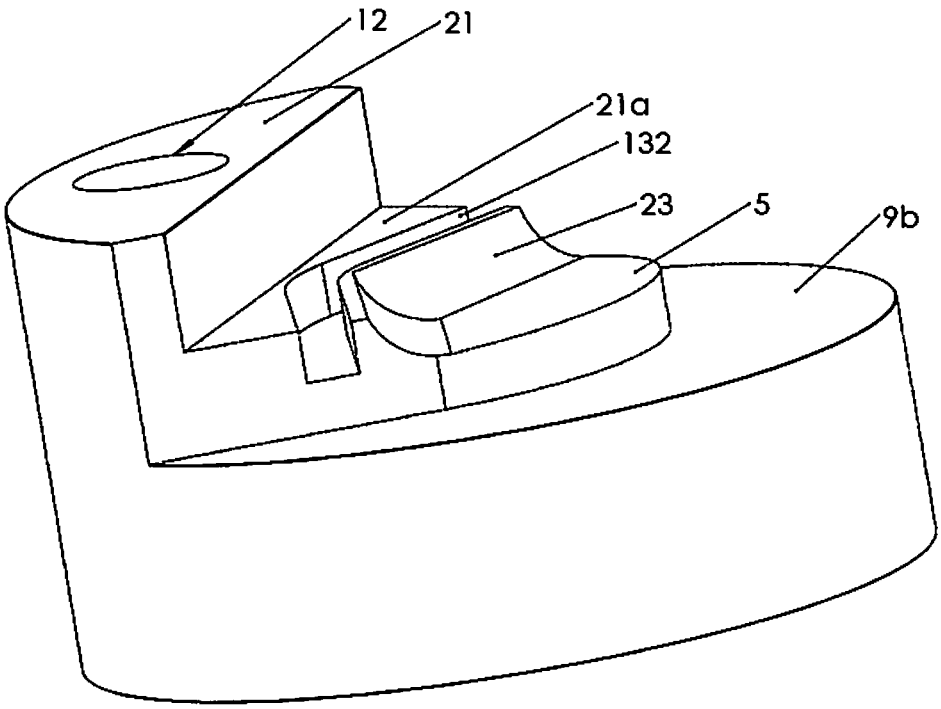
FIG. 13 is a side perspective view similar to FIG. 7 with a sealant recess.

FIG. 13 is similar to FIG. 12 except that filleted area/deflector 23 is full straight across. Channel 132 prevents leakage of fluids when the elastomer is in place.

Figure 14:
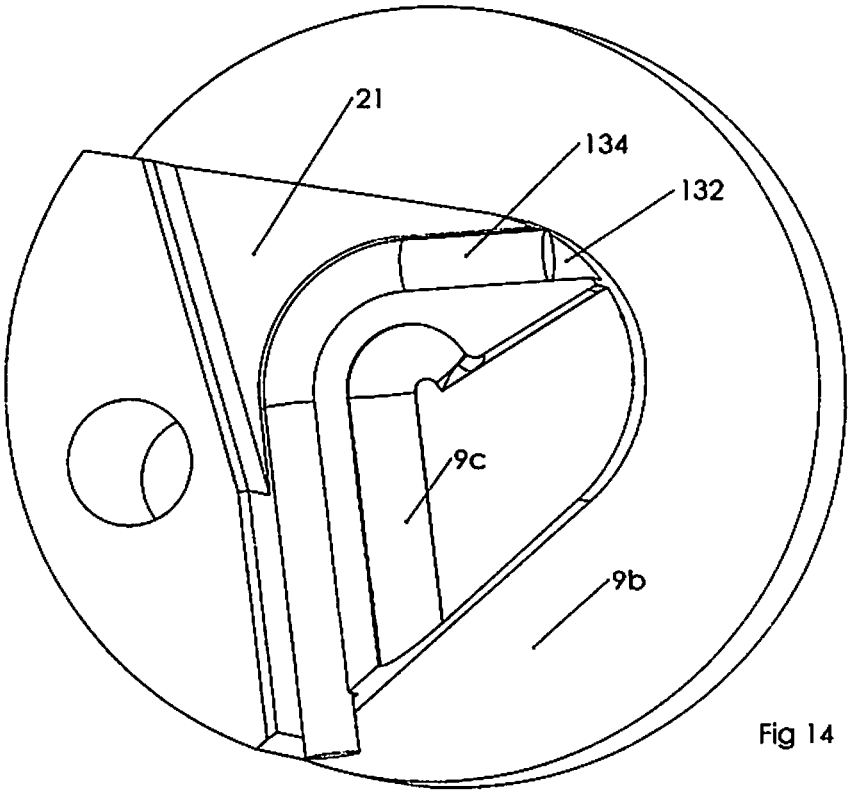
FIG. 14 is a top view similar to FIG. 4 or FIG. 5 with a sealant recess and O-ring in place.
Figure 15:
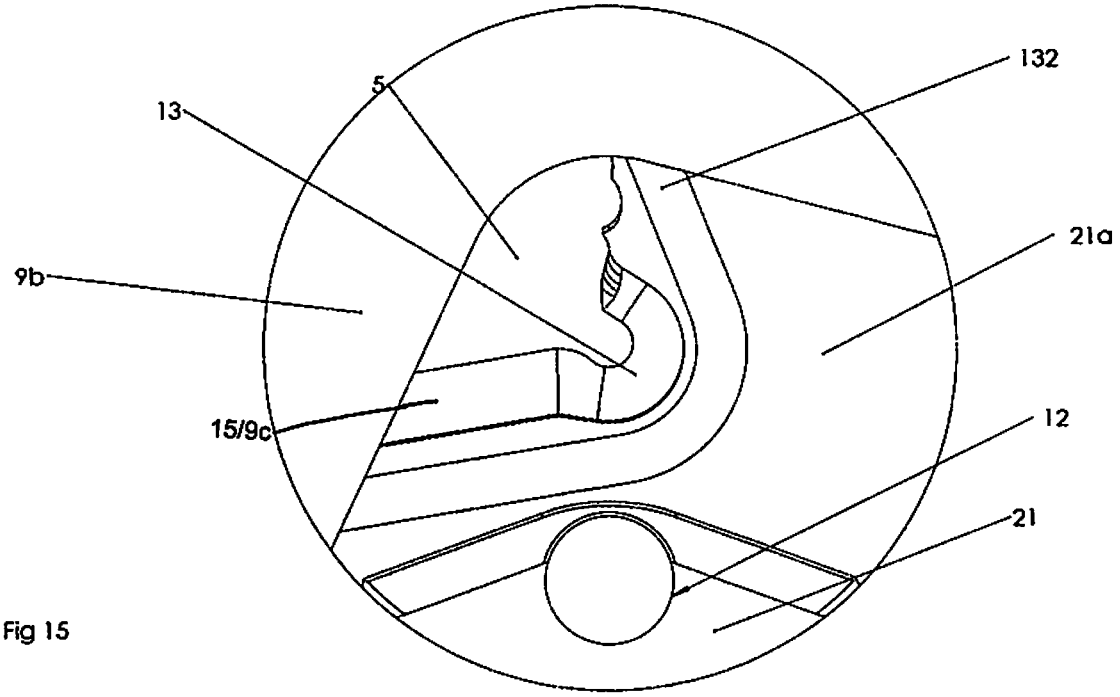
FIG. 15 is a top perspective view of FIG. 14 with a sealant recess.

FIG. 14 is a top of view of the subject matter of FIG. 15, which is an angled flow head with a spherical indentation 13 similar to FIG. 3, but with the channel 132 this time shown with an elastomer 134. Elastomer 134 shown is cylindrical and sized to have a diameter to be equal to or greater than the wall to wall width of the channel. It could also have a volume equal to or greater than the volume of the sum of channels 130/132. The elastomer may also be an adhesive filling at least part of the channel or an expandable product such as a foam which could be injected into or applied in either or both channels. If injected, the head and body should be assembled so that here is no foam leakage.

Figure 16:
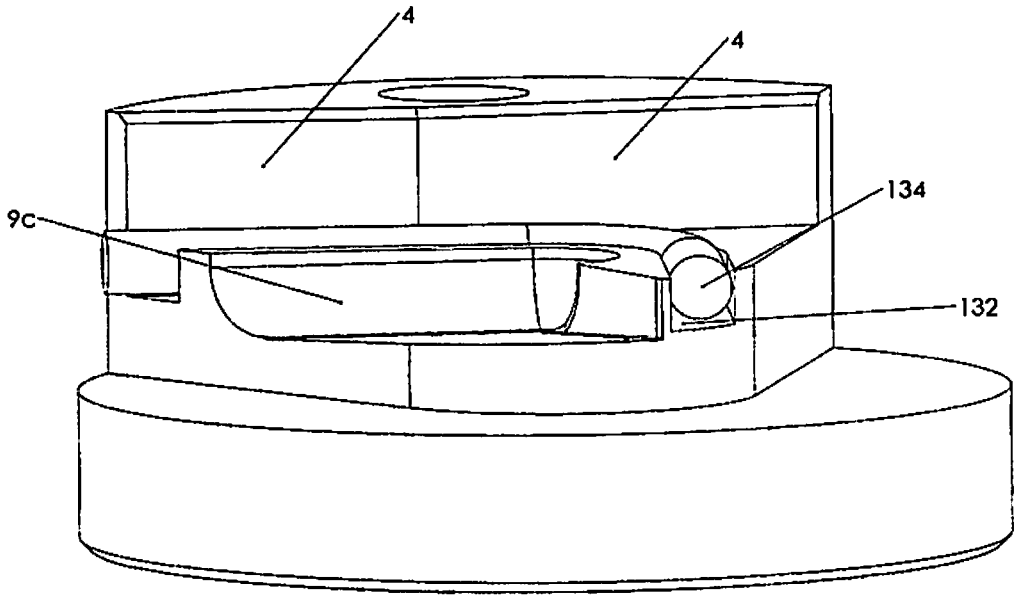
FIG. 16 is a side view of FIG. 14 with a sealant recess and O-ring.

FIG. 16 shows a side view with elastomer 134 visible in cross section.

Channels 130/132 extend preferably along the entire length of the surfaces which mate together between the head and body. Most commonly the head surface is shorter or smaller than the body so the preferred length is the shorter of the two. The FIG. 11, the length of channel 130 is equal to the length of channel 132 in FIGS. 12-15. The elastomer can extend beyond the channel or be cut flush with the body/head edges. Also disclosed herein is a method of constructing a nozzle according to this disclosure having a discharge surface, an orifice in the discharge surface, and an impingement surface comprising: a.) providing an orifice for conducting a pressurized fluid onto an impingement surface, b.) locating the impingement surface at a deflection angle measured relative to a centerline of the orifice, the angle being 90 degrees or less; c.) deflecting the fluid along a deflection ridge bridging a gap between the impingement surface and the discharge surface; d.) forming a trough in the impingement surface adjacent the deflection ridge d. locating the orifice orthogonally relative to the discharge surface; and e.) limiting the cross sectional extent of the impingement surface so that its extent is less than the extent of the discharge surface; so that fluid exiting the orifice will generally strike the impingement surface and subsequently flow along the discharge surface before being discharged from the nozzle.

Also disclosed herein, is a method of dispersing fluid, having the following steps in any order; discharging a pressurized fluid from an orifice onto an impingement surface, the impingement surface oriented at a deflection angle measured relative to a centerline of the orifice, the angle being less than 90 degrees; deflecting at least a portion of the fluid at the impingement surface to form an impingement flow; and deflecting at least a portion of the impingement flow at a deflection ridge to restrict an exit plume to a limited circumferential angle; deflecting at least a portion of the flow into a trough cut into the impingement surface.

Also disclosed is a method of constructing a nozzle having a body with a discharge surface, an orifice in the discharge surface, and a head having an impingement surface comprising: a.) forming a channel across a surface of the either the body or the head where the surfaces on both meet when assembled; b) providing an elastomeric filler which substantially fills the channel(s) so that the head and body surfaces have a fluid tight surface therebetween.

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

The invention claimed is:

1. A spray nozzle, comprising:

a nozzle capable of spraying a liquid having only first and second parts of a nozzle body having a body planar contact surface and a nozzle head having a head planar contact surface configured to engage the nozzle body planar contact surface; said head contact surface having a peripheral edge;

a channel formed in the head planar contact surface starting from a first point on said peripheral edge and extending to an end point on said peripheral edge; thereby dividing the head planar contact surface with said channel, so that the channel divides the nozzle head peripheral edge in two places;

an elastomer sized to be receivable within said channel such that when emplaced within the channel, the channel extends from said first point to said end point on said nozzle head peripheral edge, into thereby creating an elastomeric seal between said nozzle body and nozzle head along said channel.

2. The spray nozzle of claim 1 wherein said channel has spaced apart vertical sidewalls and a planar bottom wall therebetween.

3. The spray nozzle of claim 1 wherein said channel has spaced apart vertical sidewalls and a concave bottom wall therebetween, and wherein said elastomer has a tubular cross section.

4. The spray nozzle of claim 1 wherein said channel has spaced apart vertical sidewalls and a v-shaped bottom wall therebetween.

5. The spay nozzle of claim 1 wherein said elastomer has a cross sectional area greater than or equal to the cross sectional area of the channel.

6. The spay nozzle of claim 1 wherein said elastomer has a cross sectional area greater than the cross sectional area of the channel and wherein the elastomer is compressible to fit within the channel and exert a bias force against said channel.

7. The spray nozzle of claim 1 wherein the nozzle body further includes a mounting hole for affixing the head to the body and wherein said channel intersects said mounting hole.

8. The spay nozzle of claim 1 wherein the elastomer is an injectable fluid which hardens in place.

9. A spray nozzle, comprising:

a nozzle capable of spraying a liquid having only first and second parts of a nozzle body having a first body planar contact surface in a first plane; and a nozzle head having a planar head contact surface configured to engage the nozzle body planar contact surface;

said head planar contact surface having a peripheral edge;

a channel formed in said nozzle head planar contact surface starting from a first point at the peripheral edge and extending to an end point on said peripheral edge; so that the channel divides the peripheral edge in two places, thereby dividing the contact surface with said channel;

said channel on said nozzle head planar surface located to engage said nozzle body;

an elastomer, which extends within said channel from said first point to said end point on said peripheral edge, sized to be receivable within said channel such that when emplaced under pressure within the channel, said elastomer engages said body planar surface thereby creating an elastomeric seal between said nozzle body and head along said channel by compression.

* * * * *